United States Patent [19]

Jonkers

[11] 4,299,164

[45] Nov. 10, 1981

[54] SQUEEGEE FOR SCREEN PRINTING MACHINE

[75] Inventor: Thomas M. Jonkers, Nijmegen, Netherlands

[73] Assignee: Stork Brabant B.V., Boxmeer, Netherlands

[21] Appl. No.: 68,082

[22] Filed: Aug. 20, 1979

[30] Foreign Application Priority Data

Nov. 14, 1978 [NL] Netherlands ..... 7811246

[51] Int. Cl.[3] ..... B41F 15/08

[52] U.S. Cl. ..... 101/120; 101/119

[58] Field of Search ..... 101/115, 116, 117, 119, 101/120, 124, 125

[56] References Cited

U.S. PATENT DOCUMENTS

| | | | |
|---|---|---|---|
| 945,264 | 1/1910 | Dick | 101/120 |
| 3,592,132 | 7/1971 | Weber | 101/119 |
| 3,735,730 | 5/1973 | Mitter | 101/120 X |
| 3,795,188 | 3/1974 | Giani | 101/120 X |
| 3,796,153 | 3/1974 | Jaffa | 101/119 X |
| 3,878,780 | 4/1975 | Lotte | 101/119 |
| 3,930,445 | 1/1976 | Jaffa | 101/124 X |
| 4,138,943 | 2/1979 | Mitter | 101/120 X |

FOREIGN PATENT DOCUMENTS

| | | | |
|---|---|---|---|
| 2413731 | 10/1974 | Fed. Rep. of Germany | 101/120 |

*Primary Examiner*—Edward M. Coven

*Attorney, Agent, or Firm*—Edmund M. Jaskiewicz

[57] ABSTRACT

A squeegee structure for a rotary screen printing machine comprises a fixed portion forming the main supporting element, said portion being adjustable in position. The squeegee further comprises a movable intermediate member, such as a blade of resilient spring steel connected along one edge to said fixed portion, a plastic element having an invariable shape and a smooth and hard surface being mounted on the opposite edge of said blade.

2 Claims, 16 Drawing Figures

SQUEEGEE FOR SCREEN PRINTING MACHINE

BACKGROUND OF THE INVENTION

The present invention relates to a squeegee for pressing a dyepaste through a sieve of a printing machine, especially a rotary screen printing machine for printing a web of material. The squeegee is composed of an adjustable fixed portion, a movable intermediate member and a part which, during printing, presses the dyepaste through the sieve, said part of the squeegee consisting of a material having a low coefficient of friction and a high resistance to wear.

A squeegee of this type is known per se and is described in Netherlands Patent Application No. 73.13509 (corresponding to U.S. Pat. No. 3,998,158). In this known squeegee a resilient metal blade is provided at its operative edge with a strip of material having a low friction in non-dry circumstances. The use of such material is of particular importance, since vibrations in the squeegee blade, are avoided especially when so-called boundary lubrication between the squeegee blade and the stencils of the screen printing machine occurs.

A proper operation of a squeegee in a screen printing machine requires that part of the squeegee cooperating with the stencil, to cause a reduced friction.

Consequently the material to be employed should have a low coefficient of friction. This material should further have a considerable resistance to wear as the squeegee continuously brushes past the inner wall of the stencil. The material should also have a reduced initial friction.

A drawback of this type of coating material known from the above mentioned reference(s) consists in that it is rather difficult to apply (fix) this material by gluing. This gluing is essential as soon as a metal squeegee blade has to be coated with a material having a low coefficient of friction and a considerable resistance to wear.

SUMMARY OF THE INVENTION

It is a first object of the present invention to improve a squeegee comprising this type of coating material such, that a wedge-shaped nip angle can be applied at the tip of the squeegee, which angle is not influenced by the elastic deformation. The nip angle of the squeegee should only be variable by an angular adjustment of the intermediate member with respect to the stencil. This angular position should remain constant after an optimum adjustment of this nip angle whereby the contact pressure of the squeegee upon the stencil should remain variable.

This is attained according to the invention in the squeegee of the type as mentioned before, in that part of the squeegee, intended to cooperate with the screen, consists of a plastic element having an invariable shape with a hard and smooth surface, which element is supported relative to the fixed portion, in a resilient manner. This presents the advantage that a correct functioning of the squeegee can be obtained without suffering a deformation of the squeegee. Moreover the advantage is obtained that in each printing situation an optimum condition of the squeegee relative to its nip angle and pressing force, can be pre-adjusted and maintained during operation. This adjustment of the squeegee is determined by the printing result as required by the printer, such as much or little penetration, much or little dye deposit, whilst moreover the following criteria can be taken into account: the required sharpness, the character or texture of the substrate to be printed such as cloth, paper etc., the openness, the thickness and the moist-absorbing capacity of the cloth, the spreading behaviour of the dyepaste, the fineness and the permeability of the stencil, the printing velocity and further factors. Depending upon all these desiderata, a special nip angle or wedge-shape should be chosen to obtain an optimum result. This is possible with the squeegee comprising the features as recited above in which the shape of the plastic element can be determined at will.

According to a further aspect of the present invention, the plastic element may be mounted in or around a fitting which is yieldable with respect to the fixed but adjustable portion of the squeegee. The element itself may also be yieldingly mounted to the fixed portion.

In accordance with a further aspect of the present invention, the squeegee is so embodied, that the face of the plastic element which is in contact with the dyepaste is lying flush with the side of the movable intermediate member turned toward the stencil.

Employing a non-deformable plastic element according to the invention, renders it possible to obtain a particular embodiment of the squeegee by the use of a resilient cushion between the plastic element and the intermediate member on the one hand, and the fixed portion of the squeegee on the other hand.

It is observed that it is known per se to use in an elastic cushion a squeegee, vide for instance the U.S. Pat. Nos. 3,930,455, 3,878,780 and 3,795,188. In these known squeegees however, a slideable pressure bar is always applied between the resilient cushion and the squeegee blade, causing friction to inevitably occur, so that the pressing force exercised by the cushion cannot be accurately determined.

In a particular embodiment of the squeegee according to the invention either the plastic element is incorporated in the elastic cushion, or the cushion is incorporated in the intermediate member.

SURVEY OF THE DRAWINGS

FIGS. 1–6*a* are transverse sections through different embodiments of a squeegee for a rotary screen printing machine.

Figure 1:
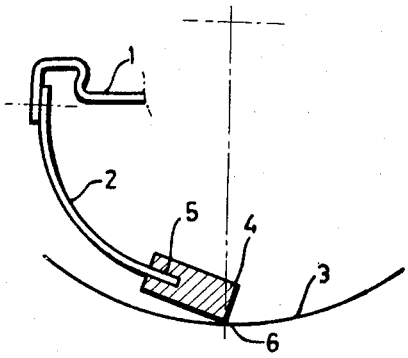

FIGS. 12*a*–13*b* show two variants on an enlarged scale, of a mounting structure of the plastic element to a thin squeegee blade.

DESCRIPTION OF PREFERRED EMBODIMENTS

FIGS. 1–6 show an adjustable but fixed portion 1 known per se, of a squeegee, provided with a yieldable and elastic blade 2 consisting for example of steel. The squeegee cooperates with a base which in the present case consists of a stencil 3 of a rotary screen printing machine. An element 4 of the squeegee cooperating with the stencil 3 is embodied as a profiled strip which according to FIG. 1, has the shape of a rectangular prism. The narrow side of this prism has a recess 5 in which the edge of the blade 2 fits. The lower edge 6 of the strip 4 constitutes the brushing edge and this embodiment is chosen in case the printer wants a variable nip angle or wedge with a long upper side of the nip in order to obtain a substantial dye deposit.

Figure 2:
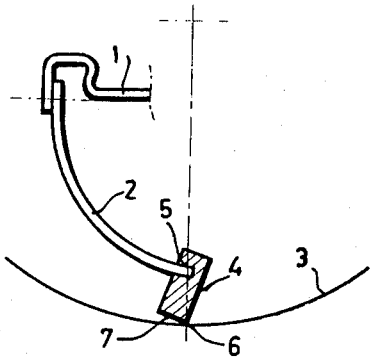

In the prismatic shape according to FIG. 2 the strip 4 is also rectangular in cross-sectional view but the narrow side 7 is directed toward the stencil 3. This embodiment will be chosen when the printer wants a very sharp printing result with a reduced dye deposit, requiring a short upper surface of the wedge.

Figure 3:
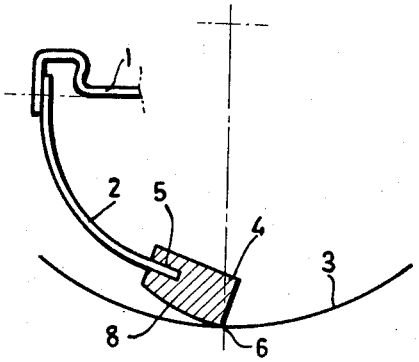
Figure 4:
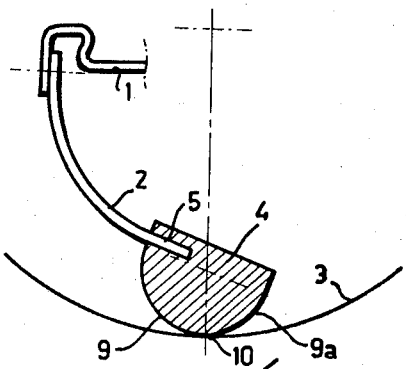
Figure 5:
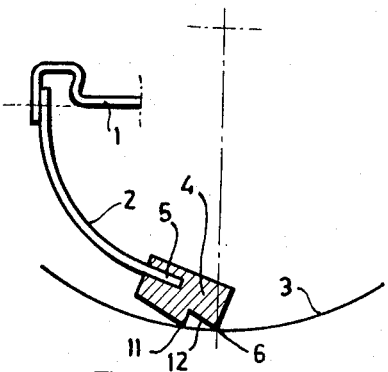

FIG. 3 shows a strip 4 having a curved side 8 forming the upper boundary of the wedge. In this embodiment the nip angle is greatly variable and a considerable dye deposit can be obtained. It is also possible to keep the nip angle constant under all circumstances when, instead of a curved face 8 with an edge 6, a completely curved operative face 9 is applied, as shown in FIG. 4. The curvature of this face 9 continues beyond the contact zone 10 as indicated with the reference numeral 9*a*. In this embodiment the pressure force can be varied under a constant nip angle whereby the quantity of the dyepaste which is deposed through the stencil is constant. By means of the variable pressure force, the penetration depth of the dyepaste can be adjusted.

In order to obtain a penetration greater than is possible with the embodiment of FIG. 2, the strip 4 can be provided with a second brushing edge 11 in addition to the edge 6. The part of the lower face of the strip 4 lying between the edges 6 and 11 is provided with an additional wedge face 12, vide FIG. 5. The adjustment of this squeegee is somewhat critical, but is at any rate feasible between practical boundaries. In this embodiment a very considerable penetration may be obtained.

Figure 6:
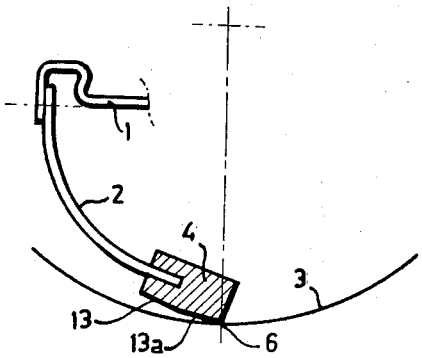
Figure 6A:
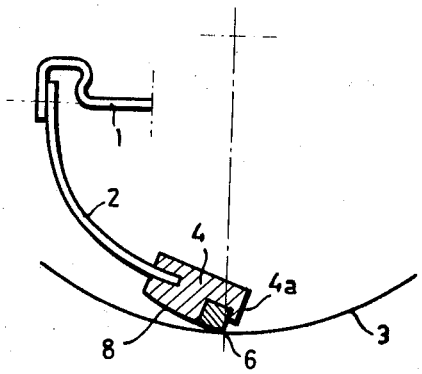

In the embodiment of FIG. 6 it is possible to obtain a great deposit in consequence of a high pressure within the dye by means of a strip 4. This strip 4 has an angular lower face forming the upper boundary of the wedge, said face consisting of a portion 13 and a portion 13*a*. The nip angle of this latter portion is very reduced. The strip 4 can also be provided with a separate insert 4*a* to the edge 6 of which is brushing the stencil, vide FIG. 6*a*.

The above described variants can be realized in consequence of the fact that the brushing edge cooperating with the base (the stencil 3) forms part of an element of invariable shape. This element 4 is connected to the fixed portion 1 of the squeegee through the resilient blade 2. In known squeegees composed of a resilient blade comprising a whether/or not low-frictional coating, the latter was impossible up till now.

Figure 7:
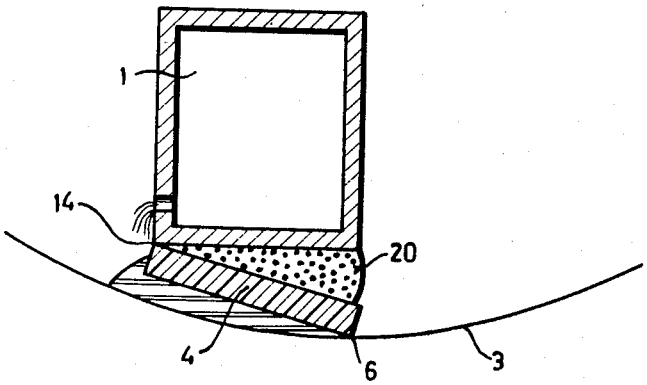
FIG. 7 is a section of a squeegee comprising an elastic cushion.
Figure 8:
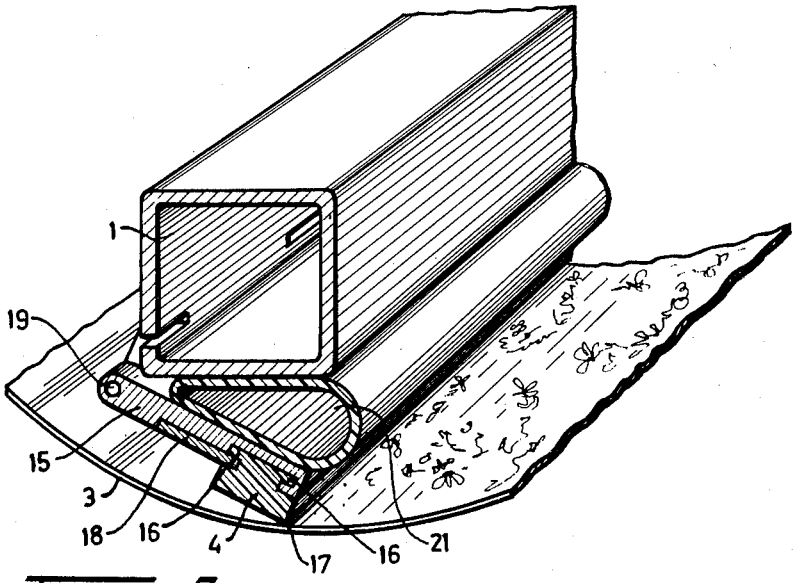
FIG. 8 is perspective view of a squeegee with an elastic gas cushion.

In the particular embodiment of FIG. 7 the strip 4 is directly connected through a pivot 14, with the fixed portion or girder 1. Between this portion 1 and the element 4 a resilient cushion 20 containing a fluid is accommodated. In the embodiment of FIG. 8, the element 4 is mounted by means of ridges 16 behind a frame 18, forming part of a blade 15. This dovetail structure serves to keep the strip 4 at its correct position. The strip 4 has an edge 17 brushing the stencil 3. The plate 15 comprises a pivot 19 for connection with the portion 1 of the squeegee.

The position of the fixed portion 1 is in a manner known per se, adjustable prior to the printing operation. Between the plate 15 and the portion 1 an elastic cushion is accommodated, embodied by an inflatable gas hose 21. By adjustment of the pressure in the hose 21, the pressing force of the strip 4 against the base 3 can be determined. By applying the profiled strip 4 a correct and uniform repartition of the pressure is obtained. This pressure depends upon the requirements of the printer in connection with the non-uniformity of the cloth etc. In order to keep the working conditions of the squeegee as uniform as possible along its entire operating length, the hose 21 can possibly be divided into sections, thereby applying slightly different pressures in the subsequent sections of the hose. Abrupt transitions do not occur in consequence of the fact that the strip 4 has an invariable shape.

The fluid in the hose can either be a liquid or a gas. It is to be noted that the pressure of the squeegee can be adjusted without any alteration in the nip angle of the squeegee. Moreover the invention renders it possible to obtain a stepless change in the fluid pressure during the printing operation. In this manner it is possible to obtain a considerable "brilliance" with the dyepaste upon the upper side of the cloth and little penetration by means of a low pressure. By increasing the pressure the penetration also increases, so causing relatively less paste to be lying on the upper face of the cloth by exercizing a high pressure within the cushion. A gradual and stepless change from one type of printing result to the other type is obtainable in the squeegee according to this invention. It is thereby not necessary to apply squeegee blades of different rigidity.

Figure 9:
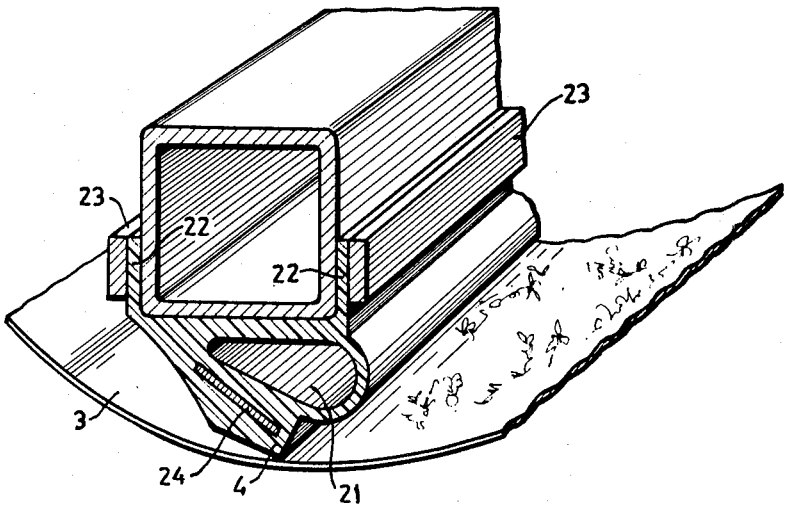
FIG. 9 shows a one-piece-squeegee comprising an elastic cushion.

When the printer wants to use a relatively stiff squeegee, a stiffening in the strip may be applied, for example a metal tape 24 as shown in FIG. 9. The same FIG. 9 shows the possibility to incorporate the elastic cushion within the material of the strip 4. In the same manner as described relative to FIG. 8, the cushion 21 is filled with fluid (gas) under pressure. The embodiment of FIG. 9 has been manufactured by extrusion, by means of which two flanges 22 are manufactured which are secured upon the fixed portion 1 by means of strips 23. The profiled strip may also be combined with the fixed portion and a cushion, which cushion may be manufactured from a foam plastic, means being provided for supporting the cushion against shearing forces.

Figure 10:
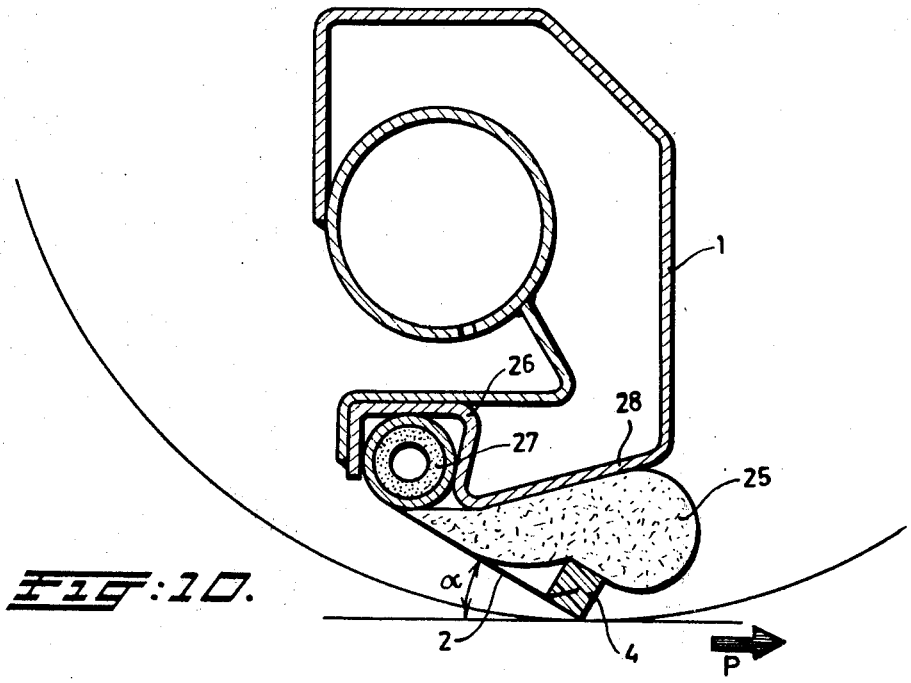
FIGS. 10 and 11 are two further embodiments of a squeegee with a fluid cushion.

FIG. 10 shows an embodiment in which the cushion is constituted by a thin-walled hose or bag 25 one edge of which is clamped together with the squeegee blade 2, in a fitting 26 of the fixed portion 1 by means of an inflatable hose 27 known per se from the Netherlands Patent Application No. 73,04508. The pressure exercised by the inflatable bag or hose 25 upon the strip element 4 provides for an independence between the nip angle$\alpha$ (accounting for the degree of the position) on the one hand, and the pressure force exercised by the strip 4 upon the base (accounting for the degree of penetration) on the other hand. As shown in FIG. 10, the upper side of bag 25 is in contact with an inclined lower face 28 of the fixed portion 1 of the squeegee.

Figure 11:
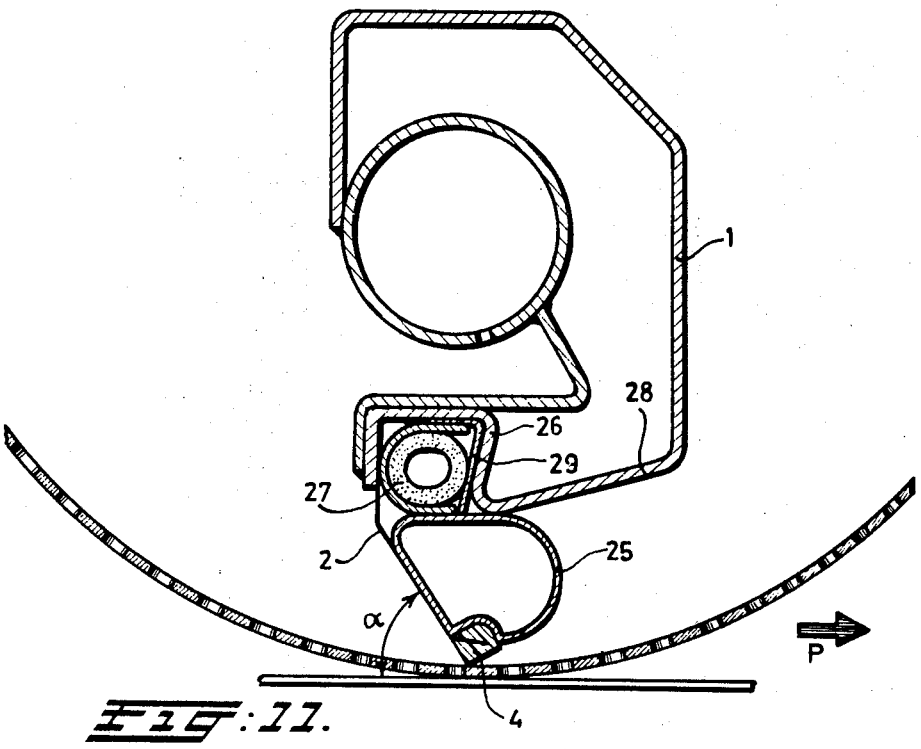
Figure 12A:
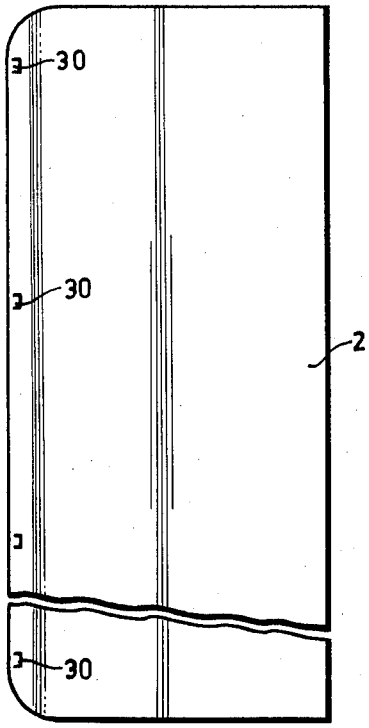
Figure 12B:
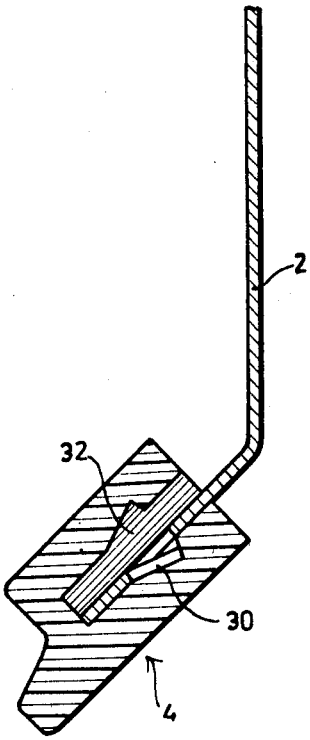
Figure 13A:
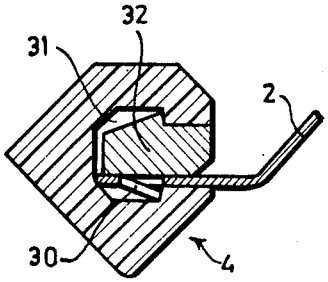
Figure 13B:
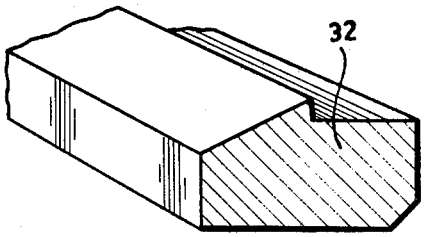

FIG. 11 shows a variant of the squeegee according to FIG. 10 wherein the bag or hose 25 is provided with a side lip 29 which is clamped within the fitting 26 by means of the inflatable tube 27, at a side lying opposite the clamping zone of the blade 2. The arrows P visible in FIGS. 10 and 11 illustrate the direction of travel of the web or strip to be printed by the stencil 3 and the squeegee structure as shown in these Figures.

FIGS. 12*a*, 12*b* and 13*a*, 13*b* show two variants of a structure for mounting the plastic element (the strip 4) upon the tip of the movable intermediate member (the blade 2) of the squeegee. To that end the blade 2 is provided with a number of protruding lips 30 fitting with much play in a cavity 31 in the strip 4. By means of a resilient filling bar 32, the strip 4 is secured to the tip of the blade 2.

What is claimed is:

1. A squeegee device for pressing a dye paste through a screen of a printing machine, particularly a rotary screen printing apparatus, for printing a web of material and comprising an adjustable stationary element, a resilient blade having one edge mounted from said stationary element and having a free edge directed toward a screen such that the distance between said mounted and free edges is fixed, an edge strip of a wear-resistant plastic material mounted on said free edge of said resilient blade and engageable with said screen to to press dye paste therethrough during printing, said edge strip defining a nip angle with said screen and having an invariable shape and a smooth and hard surface, and a resilient hollow cushion containing a fluid under pressure interposed between and contacting said resilient blade and said edge strip on one hand and a portion of said stationary element on the other hand to support resiliently said edge strip with respect to the stationary element of the squeegee device whereby variation of fluid pressure within said hollow cushion exerts a force against said edge strip to vary the contact pressure of said edge strip upon said screen while the nip angle remains constant.

2. A squeegee device according to claim 1, wherein the edge strip is mounted to the blade by means of a resilient member.

* * * * *